US005947164A

United States Patent [19]

Norlin

[11] Patent Number: 5,947,164

[45] Date of Patent: Sep. 7, 1999

[54] CLOTH BEAM ARRANGEMENT FOR TUBULAR FELTS LOOM

[75] Inventor: Göran Norlin, Älmhult, Sweden

[73] Assignee: Texo AB, Älmhult, Sweden

[21] Appl. No.: 09/037,041

[22] Filed: Mar. 9, 1998

[30] Foreign Application Priority Data

Mar. 20, 1997 [SE] Sweden ..... 9701024

[51] Int. Cl.[6] ..... D03D 49/10

[52] U.S. Cl. ..... 139/308; 242/542.1; 242/530.2; 139/309

[58] Field of Search ..... 139/309, 308; 242/542.1, 530.2; 66/151, 152, 149 R

[56] References Cited

U.S. PATENT DOCUMENTS

| | | | |
|---|---|---|---|
| 3,760,609 | 9/1973 | Poocza | 66/149 R |
| 3,973,598 | 8/1976 | Pfarrwaller | 139/308 |
| 4,028,912 | 6/1977 | Schneck | 66/149 R |
| 5,381,676 | 1/1995 | Shibata et al. | 66/149 R |

FOREIGN PATENT DOCUMENTS

| | | |
|---|---|---|
| 38 33 941 A1 | 3/1989 | Germany . |
| 8703865 | 11/1989 | Sweden . |

*Primary Examiner*—Andy Falik
*Attorney, Agent, or Firm*—Pollock, Vande Sande & Amernick

[57] ABSTRACT

A cloth beam arrangement for tubular felts or cloths in a weaving machine brings about feed in the weaving machine of the overfelt and the underfelt. The arrangement comprises an upper first beam, an intermediate second beam and a lower third beam. The underfelt runs against the first and the third beam and the overfelt runs against the second beam. The arrangement comprises driving members for the beams. The weaving machine includes a sley which during weaving acts against a weaving edge which has been established. The driving members drive the beams in a way which prevents mutual longitudinal displacement movements between the overfelt and the underfelt. It is thus ensured during weaving that the overfelt and underfelt edges remain completely overlapping one another at the weaving edge.

11 Claims, 5 Drawing Sheets

CLOTH BEAM ARRANGEMENT FOR TUBULAR FELTS LOOM

TECHNICAL FIELD

The present invention relates to a cloth beam arrangement in a weaving machine for weaving tubular felts (cloths) which comprise an overfelt and an underfelt. The arrangement also comprises, for effecting the feed of the woven overfelt and underfelt in the weaving machine, a first beam or upper beam, against which the woven underfelt runs, a second beam or intermediate beam, against which the woven overfelt runs, and a third beam or lower beam, against which the woven underfelt runs. The arrangement further comprises driving members for driving the beams. The weaving machine is of the type which has a sley or reed which, during weaving, acts against a weaving edge or weaving edges which has/have been established.

The term felt is to be understood in its widest sense. Terms such as cloths, material, products are also used and are in this connection equivalent to the term felt.

BACKGROUND OF THE INVENTION

The woven product is to be used in a paper machine, that is in a machine for production of paper/paper pulp. The felt is placed in a given roller group in the paper machine. The tubular felt is in the form of a hose, the circumference of which is adapted in the weaving machine to the roller group in the paper machine in which it is to run. When the woven felt is mounted in the paper machine, the side walls of the machine are dismantled so that the ends of the rollers are freed and the woven felt can then be pushed in over the roller group. To produce the tubular felts, a weaving machine is required, which has a working width corresponding to half the circumference of the felt. As a roller group in the paper machine may have a large circumference, the working width of the weaving machine becomes considerable and working widths of roughly 30 meters may be cited by way of example. Production of tubular felt is a difficult process as there are in principle two felts which lie loosely one on top of the other in the weaving machine, which may give rise to problems.

It is previously known use cloth beam arrangements with three beams. The feed of the arrangement is adjusted in such a manner that each time a shuttle passes across the width of the weaving machine, the beam system is rotated forward by a given amount which is to correspond to the thread pitch in the felt. Reference may also be made to the current system sold on the open market by TEXO AB. The system is described in, for example, Swedish patent 8703865. In this known system. all are gearwheel-synchronized and the beams are advanced by the same distance. In so-called flat-woven products with only one felt ply, the known system functions excellently.

In the weaving of the tubular felts with an overfelt and an underfelt, problems arise when the known cloth beam arrangement is used. This is because the overfelt and the underfelt can be displaced in relation to one another. As is described in greater detail below, the underfelt and the overfelt have different driving radii in the cloth beam arrangement. During advance of the cloth beams, the overfelt is moved a slightly greater distance than the underfelt as a result of the radius of movement being longer for the overfelt than for the underfelt. This has such an effect that a noticeable displacement occurs between the two felt plies at the weaving edge or beating-up edge. This means that differences arise in the sett of the two felts. The underfelt, which by means of the cloth beam arrangement has the correct adjustment, has the expected sett while the overfelt has a looser sett. This has consequences in the paper machine in connection with paper production because the tubular felt has a sett which varies around its circumference. The invention aims to solve this problem.

It is important that the identical feed of the overfelt and the underfelt during weaving can take place irrespective of the felt thickness in the woven material. The cloth beam system/weaving machine is thus to be adjustable for different felt thicknesses and still effect the desired felt feed in the case of tubular felts. The invention solves this problem also.

The main characterizing feature of the new arrangement is considered to be use of driving members which bring about driving of the beams which prevents mutual longitudinal displacement movements between the overfelt and the underfelt and thus ensures during weaving that the overfelt and underfelt edges remain opposite one another at the weaving edge(s). The term opposite means that the overfelt and the underfelt are to cover or overlap one another (completely) at the weaving edge or weaving edges respectively.

In developments of the inventive idea, the driving members are designed to effect an unsynchronized rotation of at least the first and second beams. The driving members may comprise, for the first beam or upper beam, first driving members which drive the first beam via its two ends by means of first a.c. servo-motors. The first beam is in this connection designed freely programmable with regard to the sett in the woven material.

In a further embodiment, the second beam or intermediate beam is assigned second driving members which drive the second beam at a reduced speed of rotation in relation to the third beam. The second and third beams may form part of a common driving assembly which is driven by second driving members via the two ends of each beam of the second and third beams. The second driving members may comprise gearwheels mechanically interconnecting the second and third beams. The gearwheels bring about, by means of synchronization, a slightly higher driving speed of the third beam in relation to the second beam, resulting in a desired tensile stress being maintained in the overfelt. The second and third beams which form the common driving assembly can be driven by means of second a.c. servo-motors arranged at the two ends of the driving assembly (or of the beams). The overdriving of the third beam in relation to the second beam is brought about by the gearwheel of the third beam having fewer teeth than the gearwheel of the second beam.

In a further embodiment, the driving members are designed to drive the three beams in an entirely unsynchronized manner so that there is complete programming freedom for the drive functions of the beams.

The a.c. servo-motors mentioned above may, in a known manner, be made controllable from a unit, which controls the weaving, on or close to the machine.

By means of the above proposals, the process of weaving tubular felts in a weaving machine is made easier and the sley or reed can attack a common edge of the woven felt plies, which guarantees a uniform sett around the entire circumference of the tubular felt. By the beams different speeds, the feed of the overfelt and the underfelt can be coordinated in an entirely different manner from that which has been possible previously using the known equipment. The feed is also independent of the thickness of the woven material. Differences in radius which give rise to the felt displacement are compensated by differences in speed of the beams which have essentially the same diameter.

BRIEF DESCRIPTION OF THE DRAWINGS

A presently proposed embodiment of a cloth beam arrangement according to the invention is to be described below with simultaneous reference to the attached drawings, in which.

DETAILED DESCRIPTION OF THE PREFERRED EMBODIMENT

Figure 1:
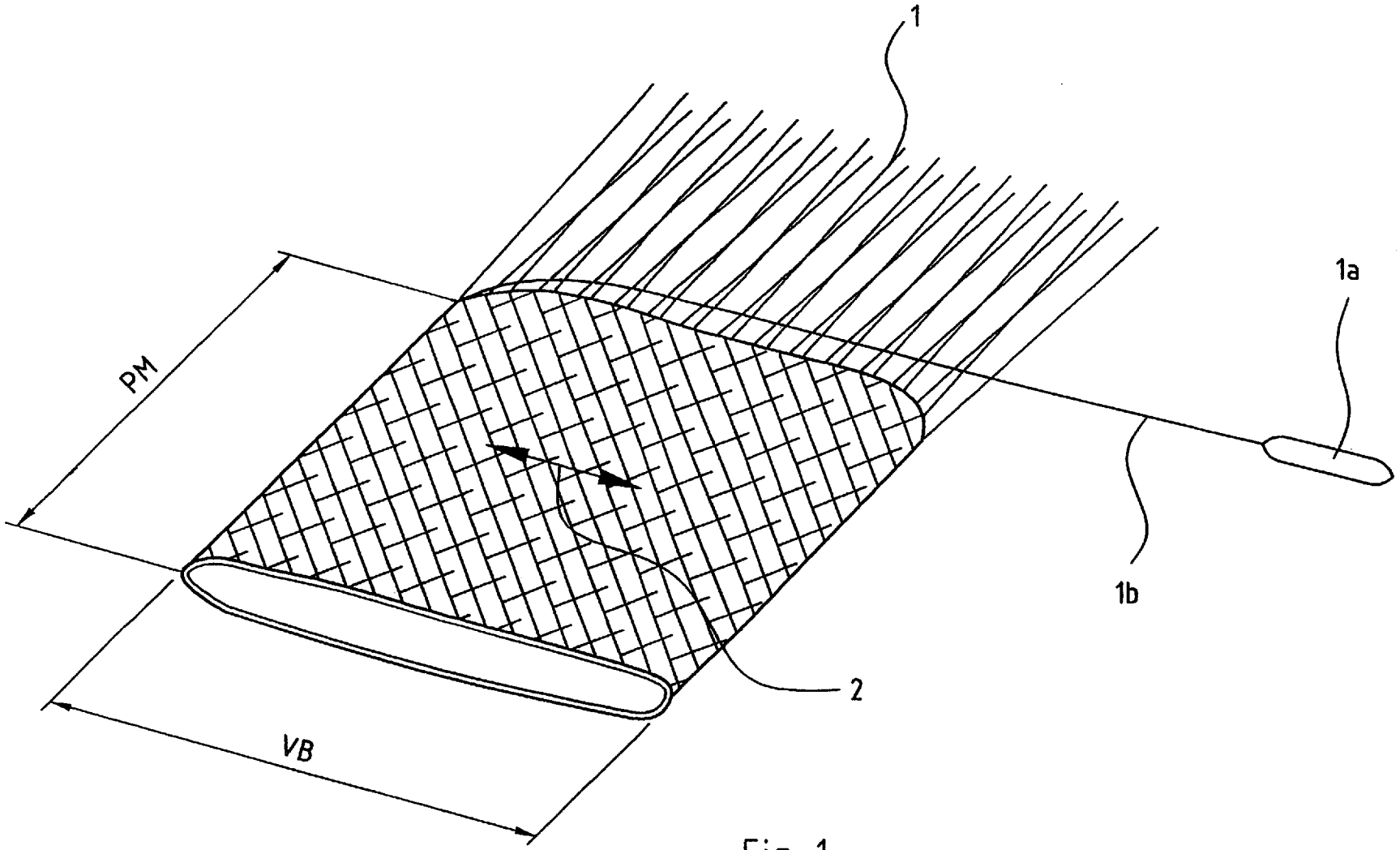
FIG. 1 shows in perspective obliquely from above an example of a tubular felt.

FIG. 1 shows the principle of a tubular felt. By means of patterning by the warp threads 1, a hose-shaped product is obtained in a weaving machine with a weaving width VB. In order to obtain a finished felt, a length is required which corresponds to a roller width PM in a given paper machine. The felt runs in a paper machine in a direction 2. A shuttle is shown by 1*a* and a weft thread connected to the latter is shown by 1*b*.

Figure 2:
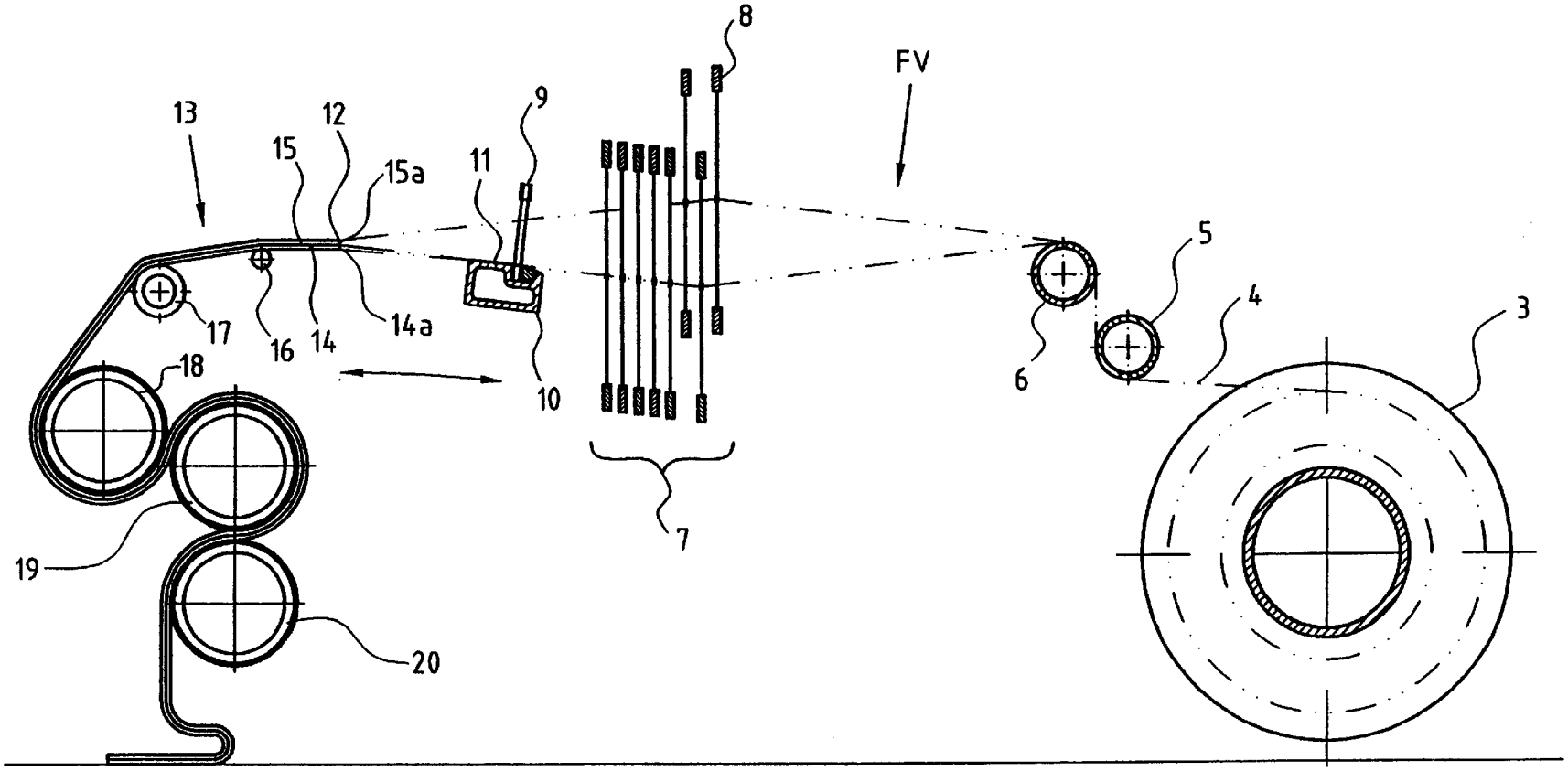
FIG. 2 shows in vertical section from the side an example of a weaving machine which can use the novel cloth beam system.

FIG. 2 shows the basic construction of a felt-weaving machine FV. The machine comprises one or more warp beams 3 where warp threads 4 are unwound. The warp passes around a guide beam 5 and over a whipe-roll beam 6 and on through the patterning arrangement 7 which may consist of up to 24 heald frames 8. The warp threads then pass through the sley (reed) 9 which is mounted on a reciprocating lay-beam 10 which bears a shuttle race 11. At a weaving edge 12, a tubular felt 13 is formed, which in principle consists of two loose felts which lie one on top of the other, the lower felt 14 here being called the underfelt and the upper felt 15 being called the overfelt. From the weaving edge, the tubular felt then extends over a breast beam batten 16 and then on over the breast beam 17. In the cloth beam system, which in most cases consists of three beams, the upper beam is indicated by 18, the intermediate beam by 19 and the lower beam by 20. The sett of the woven product is adjusted using the cloth beam system. Each time a shuttle passes across the width of the weaving machine, the beam system is rotated forward a given amount which corresponds to the thread pitch in the felt. The felt edges at the beating-up edge 12 are indicated by 14*a* and 15*a*.

Figure 3:
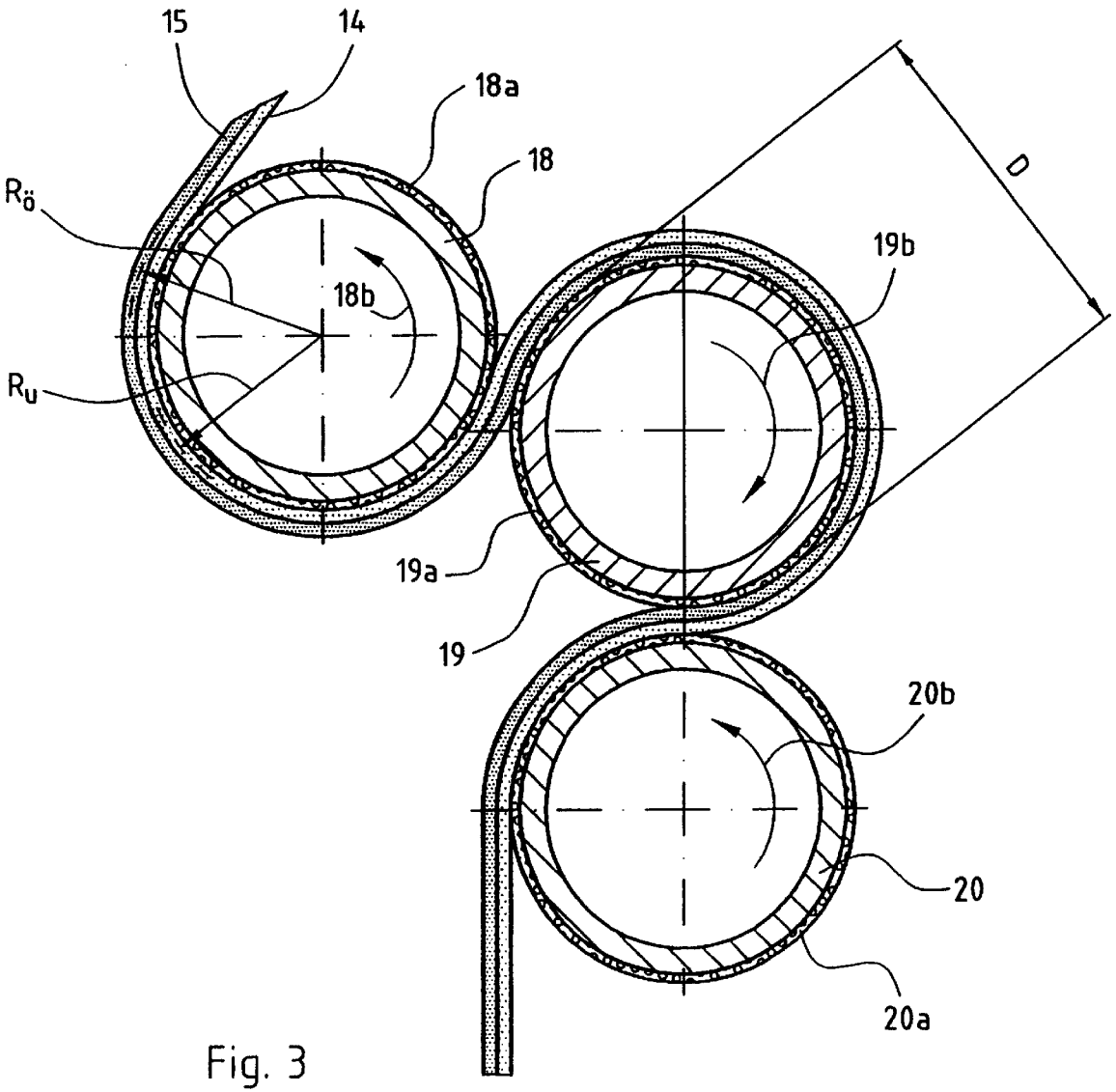
FIG. 3 shows very generally in vertical section the felt feed in a cloth beam system.

FIG. 3 shows a partial enlargement of the cloth beams 18, 19 and 20 and it can be seen from this figure that the underfelt runs against the surface 18*a* of the main beam 18 and against the surface 20*a* of the lower beam 20. The overfelt 15 runs against the surface 19*a* of the intermediate beam 19. In FIG. 3, the upper and lower beams 18 and 20 respectively rotate in the anticlockwise directions 18*b* and 20*b* respectively. The intermediate beam 19 rotates in the clockwise direction 19*b*. In the exemplary embodiment, all three beams have the same size diameters D. In other respects, the beams are constructed in a known manner. It can be seen from the figure that the underfelt 14 is driven forward with a driving radius Ru and the overfelt is driven forward with a driving radius Rö. The driving radius Rö is in this connection greater than the driving radius Ru. This means that, during advance of the cloth beams, the overfelt travels a slightly greater distance than the underfelt because of the greater radius. The result is that, during weaving according to previously known principles, a clear displacement between the two surface plies occurs at the weaving edge (see 12 in FIG. 2). This results in a lower sett in the overfelt compared with the underfelt.

Figure 4:
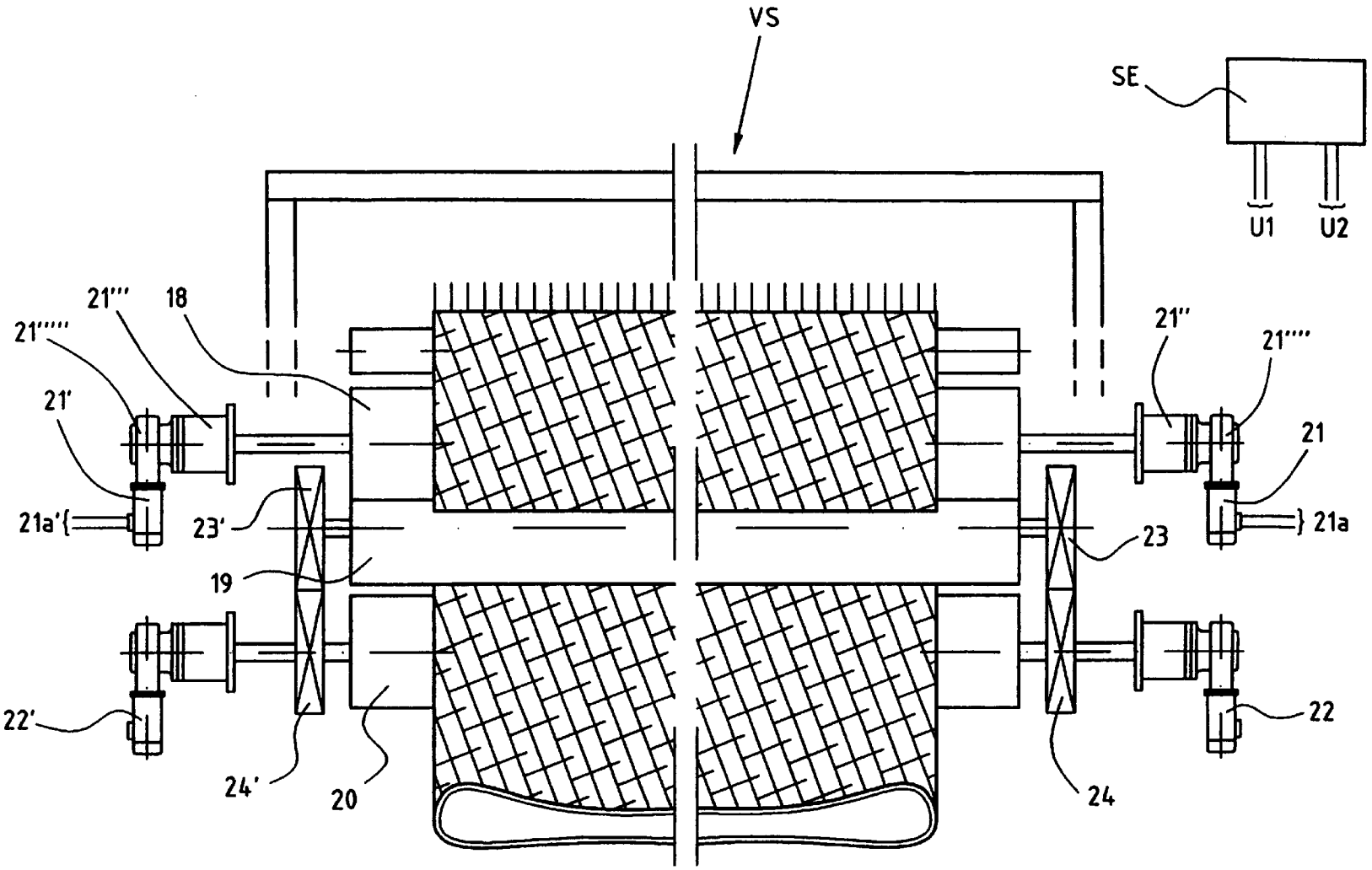
FIG. 4 shows from the front the cloth beam system with associated driving members of a first embodiment.

According to FIG. 4, the new cloth beam system or cloth beam arrangement has the same number of beams as in previous cases, that is there are three beams,—18, 19 and 20 according to the above—in the exemplary embodiment shown. In this case, the beams are not synchronized with one another. The upper beam 18 is driven at its two ends by means of a planetary gear, a worm gear and an a.c. servo-motor 21, 21'. In FIG. 4, the planetary gears are indicated by 21" and 21'" respectively. The worm gears have the designations 21"" and 21'"" respectively. The motors 21, 21' are freely programmable with regard to the sett in the felt. The programming can be carried out in a known manner via the connections 21*a* and 21*a'* respectively. In this connection, programming can take place on the control unit SE of the weaving machine, which unit is indicated only symbolically and can be constituted in a known manner known. The control unit is assumed to have control outputs U1 and U2 respectively which are connected to the connections 21*a* and 21*a'* respectively. According to the above, direct driving contact is thus made with the underfelt (see 14 in FIG. 3) and the latter thus has the correct sett. In order that both the underfelt and the overfelt lie directly one above the other at the beating-up point (see 12 in FIG. 2), the overfelt (see 15 in FIG. 3) must be braked in relation to the radial difference indicated in FIG. 3. In the exemplary embodiment according to FIG. 4, this is carried out with the aid of the intermediate beam 19 which drives the overfelt. The intermediate beam is also programmable and can be driven separately by a driving arrangement 22, 22' similar to the driving arrangement 21, 21' for the upper beam. The units 22, 22' may consist of a.c. servo-motors which are programmable from the control unit SE like the corresponding motors for the upper beam. In the case shown, the intermediate beam and the lower beam are interconnected at both ends by gearwheels 23, 24 and 23', 24' respectively. The intermediate beam and the lower beam thus together form a driving assembly, the main function of which is to control and adjust the advance of the overfelt (15 according to FIG. 3) by the intermediate beam. The lower beam 20 has been made, by gearwheel synchronization, with a small overfeed so as not to lose the tensile stress in the cloth. In FIG. 4, the drive 22, 22' has been placed on the shaft of the lower beam for purely practical, namely reasons of space in the machine concerned. Alternatively, the drive 22, 22' may be placed on the shaft of the intermediate beam. In this case, overfeed is brought about by the gearwheel 24, 24' of the lower beam having fewer teeth than the gearwheel 23, 23' of the intermediate beam. This overfeed is thus fixed and cannot be subsequently adjusted. By way of example of actual braking distances for the overfelt in relation to the underfelt, when the driving radius Rö of the overfelt is 1 mm greater than the driving radius of the underfelt, the overfelt is braked 6.0–6.6 mm, preferably about 6.3 mm, for each revolution of the cloth beam. A more precise value is $2\times\pi$(or 6.28) mm. When Rö is 2 mm greater, the exact braking distance is 12.56, and so forth.

Figure 5:
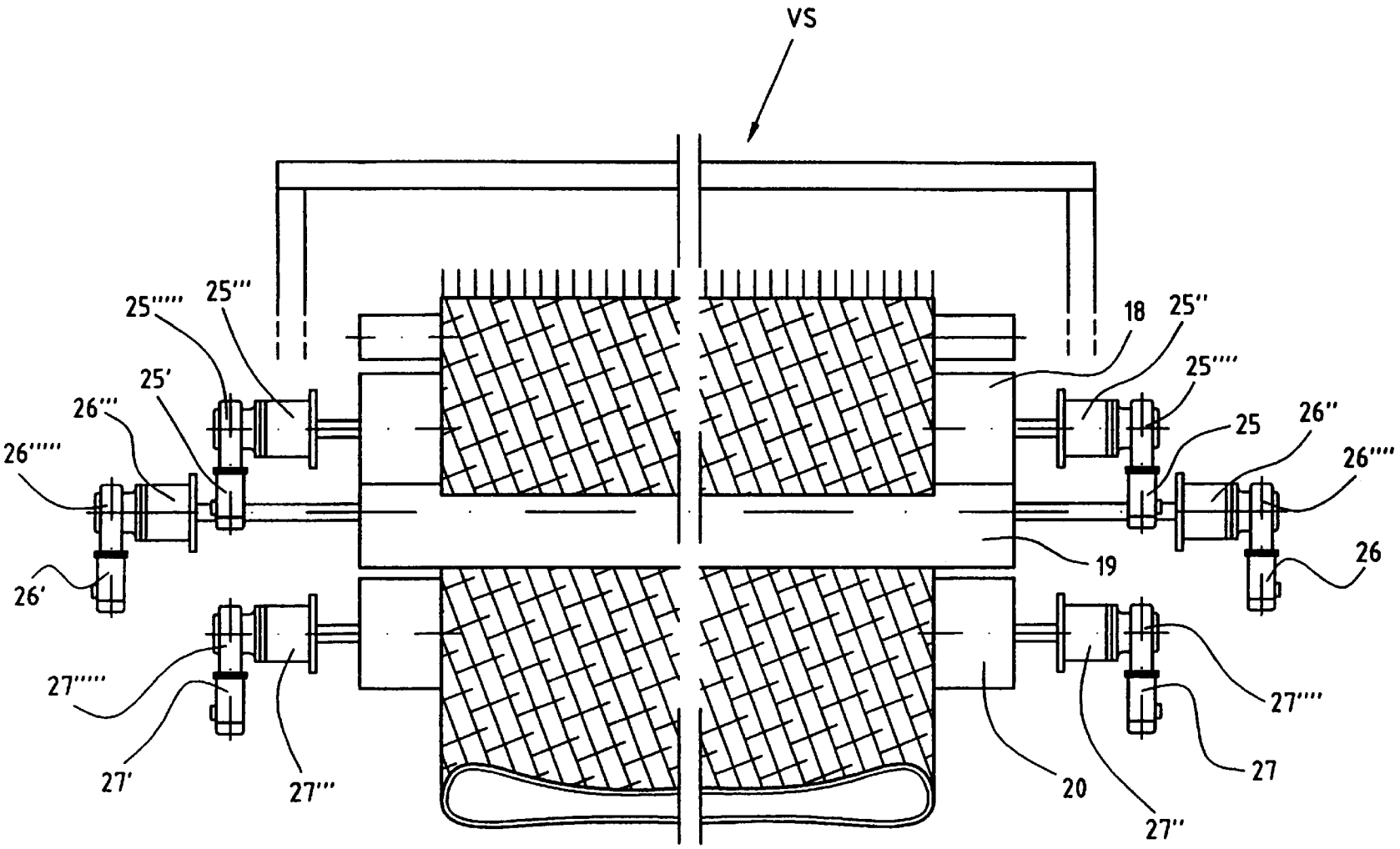
FIG. 5 shows from the front the cloth beam system with driving members in a second embodiment.

In the embodiment according to FIG. 5, all three cloth beams 18, 19 and 20 have been assigned separate drives 25, 25', 25", 25'", 25"", 25'"", 26, 26', 26", 26'", 26"", 26'"" and 27, 27', 27", 27'", 27'"", 27'"" respectively. By means of this embodiment, complete programming freedom is obtained for all the cloth beams, that is also overfeed of the lower beam 20 also. In FIGS. 4 and 5, the weaving machine itself has been symbolized by VS.

The equipment described above and the principles thereof have proved to function very well in practice. The setts are essentially the same in the two felts. In a practical test, the necessary different peripheral speeds were brought about by means of applying layers to the beams in accordance with the previously known cloth beam system. The beams were thus made with different diameters in the known system. By means of changes in diameter, the desired effect is obtained, namely that the sett in the underfelt is controlled by the, upper beam (with an increased diameter) and the intermediate beam slows down the overfelt to the correct position thanks to a slightly smaller diameter, and the lower beam, made with the same diameter as the upper beam, has a small overfeed in relation to the intermediate beam. Adjustment of the beam diameters does not represent a solution on weaving machines if the possibility of making the weaving machine easily adjustable for weaving different thicknesses is required. Varying the cloth beam diameters in accordance with the practical test may in practice be used on machines which are intended for only one type and thickness of felt.

The invention is not limited to the embodiment shown above by way of example but may be subjected to modifications within the scope of the following patent claims and the inventive idea.

I claim:

1. A cloth beam arrangement in a weaving machine for weaving tubular felts cloths including an overfelt and an underfelt, the weaving machine having a shuttle for applying weft threads through warp threads, the weaving machine also comprising a sley which, during weaving, acts against a weaving edge or weaving edges which has/have been established, the arrangement comprising means for effecting the feed of the woven overfelt and underfelt in the weaving machine, said means including a first, upper beam against which the woven underfelt runs, a second, intermediate beam against which the woven overfelt runs, and a third, lower beam against which the woven underfelt runs, and driving means for driving the beams, said driving means including driving members for driving at least two of said beams at different adjustable speeds to prevents mutual longitudinal displacement movements between the overfelt and the underfelt due to difference in the radius of said overfelt and said underfelt and thus ensure during weaving that edges of the overfelt and underfelt remain completely aligned at the weaving edge(s).

2. A cloth beam arrangement according to claim 1, wherein said driving members include means for effecting an unsynchronized driving of the first and second beams.

3. A cloth beam arrangement according to claim 1 wherein said driving members include first driving members for driving said first beam through its two ends, said first driving members including first ac servo-motors.

4. A cloth beam arrangement according to claim 3, wherein the first beam, controlled by the first driving members, is freely programmable with regard to a sett in the woven material.

5. A cloth beam arrangement according to claim 1, wherein said driving means include first driving members for driving said first beam and second driving members for driving said second beam at a reduced rotational speed with respect to the rotational speed of said third beam.

6. A cloth beam arrangement according to claim 1, wherein said second and third beams form part of a common driving assembly driven by second driving members via the two ends of each of the second and third beams, said second driving members comprising gearwheels mechanically interconnecting the second and third beams, said gearwheels effecting a slightly higher driving speed of the third beam in relation to the second beam, resulting in a desired tensile stress being maintained in the overfelt.

7. A cloth beam according to claim 6, wherein the second and third beams which form the common driving assembly are driven by second a.c. servo-motors arranged at the two ends of the driving assembly.

8. A cloth beam arrangement according to claim 6, wherein the gearwheel of the third beam has fewer teeth than the gearwheel of the second beam.

9. A cloth beam, arrangement according to claim 1, wherein the driving members comprise a.c. servo-motors for driving the beams at their respective two ends in an entirely unsynchronized manner so that there is complete programming freedom for the driving functions of the beams.

10. A cloth beam arrangement according to claim 1, wherein each a.c. servo-motor is controllable from a unit adapted to control the weaving of the weaving machine.

11. A cloth beam arrangement according to claim 1, wherein a braking distance per respective cloth beam revolution is $2\pi$ times the difference in radius between a driving radii of the overfelt and the underfelt, and when the driving radius of the overfelt is 1 mm greater, its braking distance per revolution is 6.28 mm, and when the driving radius is 2 mm greater its braking distance is 12.56 mm.

* * * * *